US008720593B1

(12) United States Patent
Root

(10) Patent No.: US 8,720,593 B1
(45) Date of Patent: May 13, 2014

(54) PORTABLE EXPANDABLE FIRE PROTECTION CHAMBER

(71) Applicant: Warren N. Root, Prescott, AZ (US)

(72) Inventor: Warren N. Root, Prescott, AZ (US)

( * ) Notice: Subject to any disclaimer, the term of this patent is extended or adjusted under 35 U.S.C. 154(b) by 0 days.

(21) Appl. No.: 14/048,893

(22) Filed: Oct. 8, 2013

(51) Int. Cl.
*A62C 8/00* (2006.01)

(52) U.S. Cl.
USPC ..... 169/48; 169/43

(58) Field of Classification Search
CPC ..... A62C 2/06; A62C 3/0257
USPC ..... 169/48–52, 43, 67
See application file for complete search history.

(56) References Cited

U.S. PATENT DOCUMENTS 5,048,977 A * 9/1991 Robbins, III ..... 383/104
5,121,765 A * 6/1992 MacMorris, Jr. ..... 135/143
5,188,186 A * 2/1993 Nash ..... 169/48
5,469,920 A * 11/1995 Conti et al. ..... 169/48
6,001,057 A * 12/1999 Bongiovanni et al. ..... 600/21
6,438,772 B1 * 8/2002 Brown et al. ..... 5/99.1
2010/0294520 A1 * 11/2010 Aguirre ..... 169/45

* cited by examiner

*Primary Examiner* — Davis Hwu
(74) *Attorney, Agent, or Firm* — Jerry Turner Sewell

(57) ABSTRACT

A system and method provide portable protection against a fire. An expandable fire protection enclosure has at least a base enclosure member, an intermediate enclosure member and a top enclosure member. The enclosure members are nested in a transportable configuration. When needed, the expandable fire protection enclosure is placed on a surface and the enclosure members are pulled from the nested, transportable configuration to an occupiable, expanded configuration. The enclosure members are constructed from a thermally-resistant material such as thermal protection system (TPS) silica. The system may include a flexible barrier positionable around an inner perimeter of the base enclosure member. The system may be placed on a thermally protective blanket.

15 Claims, 10 Drawing Sheets

PORTABLE EXPANDABLE FIRE PROTECTION CHAMBER

BACKGROUND OF THE INVENTION

1. Field of the Invention

The present invention is in the field of fire safety devices for firefighters.

2. Description of the Related Art

Firefighters often find themselves fighting fires in changing environmental conditions. For example, firefighters fighting wildfires are at the mercy of changing wind velocities and directions. At one moment, the firefighters appear to be successfully fighting a fire that is being driven away from them. Only minutes later, the wind may change directions and start blowing the fire toward the firefighters at very high velocities (e.g., up to ¼ mile per minute), which is much faster than the firefighters are able to travel over rough, vegetated terrain. Although firefighters carry portable shelters, such shelters are not always effective against such intense flash fires driven by high winds through thick vegetation. Accordingly, a need continues to exist for a portable fire protection shelter that can be deployed quickly and that can provide protection against the intense heat of wind-driven fires.

SUMMARY OF THE INVENTION

An aspect of embodiments disclosed herein is a system and method that provide portable protection against a fire. An expandable fire protection enclosure has at least a base enclosure member, an intermediate enclosure member and a top enclosure member. The enclosure members are nested in a transportable configuration. When needed, the expandable fire protection enclosure is placed on a surface and the enclosure members are pulled from the nested, transportable configuration to an occupiable, expanded configuration. The enclosure members are constructed from a thermally-resistant material such as thermal protection system (TPS) silica. The system may include a flexible barrier positionable around an inner perimeter of the base enclosure member. The system may be placed on a thermally protective blanket.

Another aspect of embodiments disclosed herein is an expandable fire protection enclosure having a collapsed transportable configuration and an expanded occupiable configuration. The enclosure includes a base enclosure member comprising a perimeter wall of a thermally resistant material. The perimeter wall has an inner surface and an outer surface. The base enclosure member has an open top and an open bottom. The perimeter wall proximate the open top extends inwardly to form an upper ledge. At least one intermediate enclosure member has at least one perimeter wall of the thermally resistant material. The at least one perimeter wall has an inner surface and an outer surface. The at least one intermediate enclosure member has an open top and an open bottom. The at least one intermediate enclosure member has an upper ledge extending inwardly from the inner surface of the at least one perimeter wall proximate the open top. The at least one intermediate enclosure member has a lower ledge extending outwardly from the outer surface of the at least one perimeter wall proximate the open bottom. The at least one intermediate enclosure member is nested within the base enclosure member in the collapsed transportable configuration. The at least one intermediate enclosure member is slidable upwards within the base enclosure member to engage the lower ledge of the at least one intermediate enclosure member with the upper ledge of the base enclosure member in the occupiable configuration. A top enclosure member has a perimeter wall of the thermally conductive material. The perimeter wall has an inner surface and an outer surface. The top enclosure member has an open bottom and a closed top. The top enclosure member has a lower ledge extending outwardly from the outer surface of the perimeter wall proximate the open bottom. The top enclosure member is nested within the at least one intermediate enclosure member in the collapsed transportable configuration. The top enclosure member is slidable upwards within the at least one intermediate enclosure member to engage the lower ledge of the top enclosure member with the upper ledge of the at least one intermediate enclosure member in the occupiable configuration.

In certain preferred embodiments, the thermally resistant material comprises thermal protection system (TPS) silica.

In certain preferred embodiments, the at least one intermediate enclosure member comprises a first intermediate enclosure member, a second intermediate enclosure member and a third intermediate enclosure member, wherein each intermediate enclosure member has a respective perimeter wall, wherein each perimeter wall has a respective inner surface and a respective outer surface wherein each intermediate enclosure member has a respective upper ledge extending inwardly from the respective inner surface and a respective lower ledge extending outwardly from the respective outer surface, wherein the first intermediate enclosure member nests within the base enclosure member in the transportable configuration, wherein the second intermediate enclosure member nests within the first intermediate enclosure member in the transportable configuration, wherein the third intermediate enclosure member nests within the second intermediate enclosure member in the transportable configuration, and wherein the top enclosure member nests within the third intermediate enclosure member in the transportable configuration. In particular embodiments, the lower ledge of the first intermediate enclosure member engages the upper ledge of the base enclosure member in the occupiable configuration, the lower ledge of the second intermediate enclosure member engages the upper ledge of the first intermediate enclosure member in the occupiable configuration, the lower ledge of the third intermediate enclosure member engages the upper ledge of the second intermediate enclosure member in the occupiable configuration, and the lower ledge of the top enclosure member engages the upper ledge of the third intermediate enclosure member in the occupiable configuration.

In certain embodiments in accordance with this aspect of the disclosure, the lower ledge of the at least one intermediate enclosure member includes an outer perimeter, the inner surface of the base enclosure member has an inner perimeter, and the outer perimeter of the lower ledge of the at least one intermediate enclosure member is sized to engage the inner surface of the base enclosure member without inhibiting movement of the outer perimeter of the lower ledge within the inner perimeter of the base enclosure. In particular embodiments, a first engagement feature is formed in the outer perimeter of the outwardly extending lower ledge of the first intermediate enclosure member, and a second engagement feature is formed in the inner surface of the base enclosure member below the inwardly extending upper ledge of the base enclosure member. The second engagement feature is positioned on the inner surface such that the second engagement feature is juxtaposed with the first engagement feature when the lower ledge of the first intermediate enclosure member engages the upper ledge of the base enclosure member. The second engagement feature is sized and shaped to mate with the first engagement feature.

In certain embodiments in accordance with this aspect of the disclosure, an outer surface of the top of the top enclosure member includes a handle that is graspable to pull the top enclosure member and the at least one intermediate enclosure member upward with respect to the base enclosure member to expand the fire protection enclosure from the transportable configuration to the occupiable configuration. Preferably, the base enclosure member further comprises a rim that extends outwardly from the bottom of the outer surface of the perimeter wall of the base enclosure member. The rim is engageable with a boot or other foot protection to hold the base enclosure member down while pulling the top enclosure member and the at least one intermediate enclosure member upward. Also preferably, an inner surface of the top of the top enclosure member includes a handle that is graspable by a person within the fire protection enclosure in the occupiable configuration to enable the person to retain the fire protection enclosure in a position over the person.

In certain embodiments in accordance with this aspect of the disclosure, a flexible lower barrier is included. The barrier is positionable around the inner surface of the perimeter wall of the base enclosure member to provide additional protection against the entry of heated air into the fire protection enclosure. Preferably, the barrier comprises a plurality of thermally resistant spheres housed within a fire-resistant fabric.

In certain embodiments in accordance with this aspect of the disclosure, a thermally protective blanket is included. The blanket is positionable between the bottom of the base enclosure member and a surface. The thermally protective blanket comprises at least one layer of thermally resistant tiles contained between first and second layers of thermally resistant fabric. Preferably, the thermally resistant tiles comprise thermally protection system (TPS) silica material spaced to form a matrix between the two layers.

Another aspect of embodiments disclosed herein is a method of providing portable fire protection. The method comprises transporting an expandable fire protection enclosure to a location proximate to a fire. The fire protection enclosure is transported in a collapsed, transportable configuration. The expandable fire protection enclosure comprises at least a base enclosure member, an intermediate enclosure member and a top enclosure member, with the top enclosure member nested within the intermediate enclosure member and with the intermediate enclosure member nested within the base enclosure member. The method further comprises placing the expandable fire protection enclosure on a surface with a top of the fire protection enclosure parallel to the surface, and positioning the feet of a person on a rim extending from a base enclosure member of the expandable fire protection enclosure. The person pulls upward on a top surface of top enclosure member of the expandable fire protection enclosure to expand the expandable fire protection enclosure from the collapsed, transportable configuration to an occupiable configuration wherein a lower ledge of the intermediate enclosure member engages an upper ledge of the base enclosure member and wherein a lower ledge of the top enclosure member engages an upper ledge of the intermediate enclosure member. The method further comprises positioning the occupiable configuration of the expandable fire protection enclosure over a person to be protected from the fire.

In certain embodiments in accordance with this aspect of the disclosure, the occupiable configuration of the expandable fire protection enclosure is positioned on a fire protection blanket.

In certain embodiments in accordance with this aspect of the disclosure, a flexible thermal barrier is positioned around an inner perimeter of the base enclosure of the occupiable configuration of the expandable fire protection enclosure.

BRIEF DESCRIPTION OF THE DRAWINGS

Embodiments in accordance with aspects of the present invention are described below in connection with the attached drawings in which:

FIG. 4 illustrates a perspective view of the collapsed fire protection chamber of FIG. 1 as viewed from the bottom of the chamber;

DETAILED DESCRIPTION OF PREFERRED EMBODIMENTS

The fire protection chamber is disclosed herein with respect to exemplary embodiments of a system and a method. The embodiments are disclosed for illustration of the system and the method and are not limiting except as defined in the appended claims. Although the following description is directed to use of the fire protection chamber by firefighters, the fire protection chamber may be used by other emergency personnel and by civilians for protection against the effects of high intensity fires.

Figure 1:
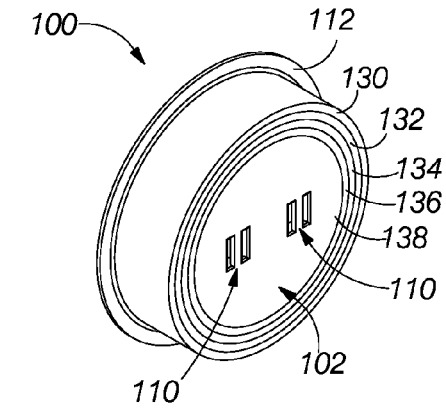
FIG. 1 illustrates a perspective view of a fire protection chamber in a collapsed (non-deployed) configuration as mounted vertically on the back of a firefighter (not shown)

FIG. 1 illustrates a perspective view of a fire protection chamber 100 in a collapsed (non-deployed) configuration as viewed from the top 102 of the chamber when the chamber is mounted vertically as on the back of a firefighter (not shown). The chamber may be carried in a backpack (not shown) or may include carrying straps (not shown) so that it can be carried in addition to a conventional backpack. Accordingly, the configuration in FIG. 1 is also referred to herein as the transportable configuration.

Figure 2:
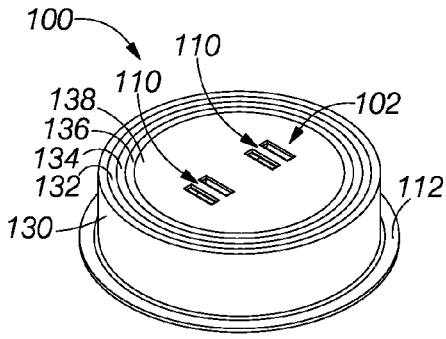
FIG. 2 illustrates the fire protection chamber of FIG. 1 removed from the firefighter's back and placed horizontally on a surface (e.g., the ground)

In FIG. 2, the fire protection chamber 100 is removed from the back of the firefighter and is positioned horizontally on a surface (e.g., the ground) with a pair of deployment handles 110 positioned upward. In the position illustrated in FIG. 2, a firefighter places his or her feet on a lower rim 112 and grasps the deployment handles with his or her hands. The firefighter then pulls the handles upward to expand the chamber from the collapsed configuration shown in FIGS. 1 and 2 to the fully deployed configuration shown in FIG. 3. When fully deployed, the chamber provides an inner cavity 120 having a tiered cylindrical shape as shown in the tilted view in FIG. 4. The cavity has a size sufficient to encompass a firefighter in a squatting position with the lower rim on the surface. The chamber has a weight that is sufficiently small that the firefighter can lift the chamber over his or her head and then lower the chamber as the firefighter squats. Alternatively, the firefighter can insert a portion of his or her body into the chamber when the chamber is in the tilted position shown in FIG. 4, and then restore the chamber to the vertical position shown in FIG. 3 with the firefighter's body entirely within the cavity. Accordingly, the configuration shown in FIG. 3 is also referred to herein as the occupiable configuration.

Figure 3:
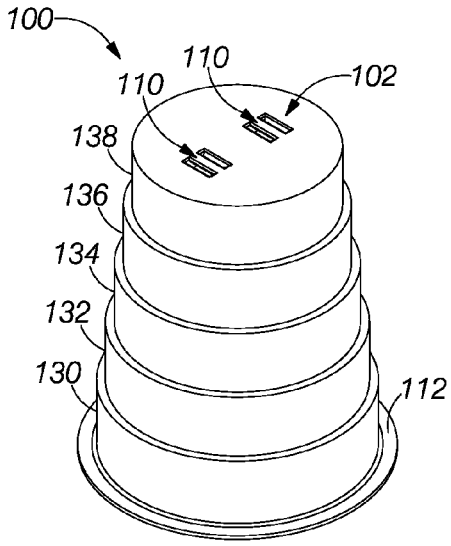
FIG. 3 illustrates the fire protection chamber of FIGS. 1 and 2 with the tiers of the chamber fully extended.
Figure 4:
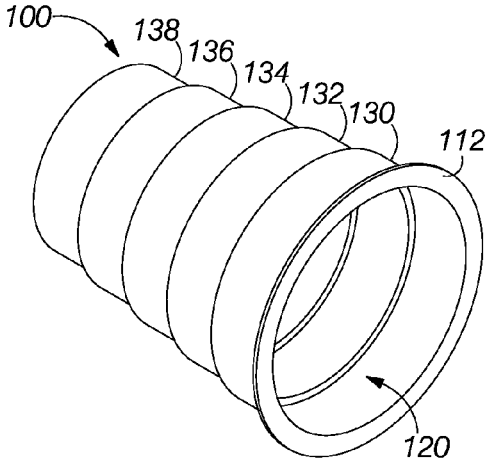
FIG. 4 illustrates the fully expanded fire protection chamber of FIG. 3 with the chamber tilted to a horizontal position to show the inner cavity of the expanded chamber.

As shown most clearly in FIG. 3, the fire protection chamber 100 comprises a plurality of ring-shaped, interlocking cylindrical tiers. In the illustrated embodiment, the fire protection chamber comprises a first (lower) tier 130, which is also referred to herein as the base enclosure member. The first tier includes the lower rim 112. A second tier 132 interlocks with the first tier and extends above the first tier when the chamber is fully deployed. The second tier is also referred to herein as the first intermediate enclosure member. A third tier 134 interlocks with the second tier and extends above the second tier when the chamber is fully deployed. The third tier is also referred to herein as the second intermediate enclosure member. A fourth tier 136 extends above the third tier and interlocks with the third tier when the chamber is fully deployed. The fourth tier is also referred to herein as the third intermediate enclosure member. A fifth (upper) tier 138, which is also referred to herein as the top enclosure member, extends above the fourth tier and interlocks with the fourth tier when the chamber is fully deployed. As shown in more detail below, the first, second, third and fourth tiers are open at each end of the cylindrical shape. As also shown in more detail below, the fifth tier is open at the lower end but has a closed upper end. The deployment handles 110 are formed into the closed upper end of the fifth tier. As shown in FIGS. 1 and 2, the five tiers appear as concentric cylinders in the collapsed (non-deployed) configuration in which the fire protection chamber is stored and transported. In the collapsed, transportable configuration, the fire protection chamber has an overall height generally corresponding to the height of the first (lower) tier. Although described herein as having five cylindrical tiers, it should be understood that the fire protection chamber may comprise more or fewer tiers. For example, the fire protection chamber may comprise as few as three enclosure members, which include a base enclosure member, an intermediate enclosure member and a top enclosure member, with each enclosure member having a greater height than the corresponding enclosure members in the illustrated embodiment.

The cylindrical tiers comprise a thermal protection system (TPS) silica material such as the LI-900 material used for the reusable surface insulation tiles for the Space Shuttle orbiters. The material was originally developed by Lockheed Missiles and Space Company and its structure is well known to the art. Such material has a very low thermal conductivity and very low thermal retention. The material advantageously comprises approximately 99.9 percent pure silica glass fibers. The material is formed such that the fibers provide a structure that comprises approximately 94 percent air by volume. The LI-900 material has a bulk density of approximately 9 pounds per cubic foot (144.2 kg/$m^3$). Alternatively, a higher strength LI-2200 TPS silica material having a bulk density of approximately 22 pounds per cubic foot (352.4 kg/$m^3$) may be used. In certain embodiments, an outer coating of carbon fiber cloth, fiberglass or other fire retardant fabric is applied to the exposed surfaces of the TPS material to provide additional strength to the frangible material. In the embodiment illustrated herein, the overall mass of the fire protection chamber when fabricated with LI-900 TPS material is slightly less than 16 pounds, and when fabricated with LI-2200 TPS material is slightly greater than 37 pounds. Although described herein with respect to the LI-900 or LI-2000 TPS silica material, it should be understood that other thermal protection material having similar combinations of high thermal resistance and low density may also be used.

Figure 5:
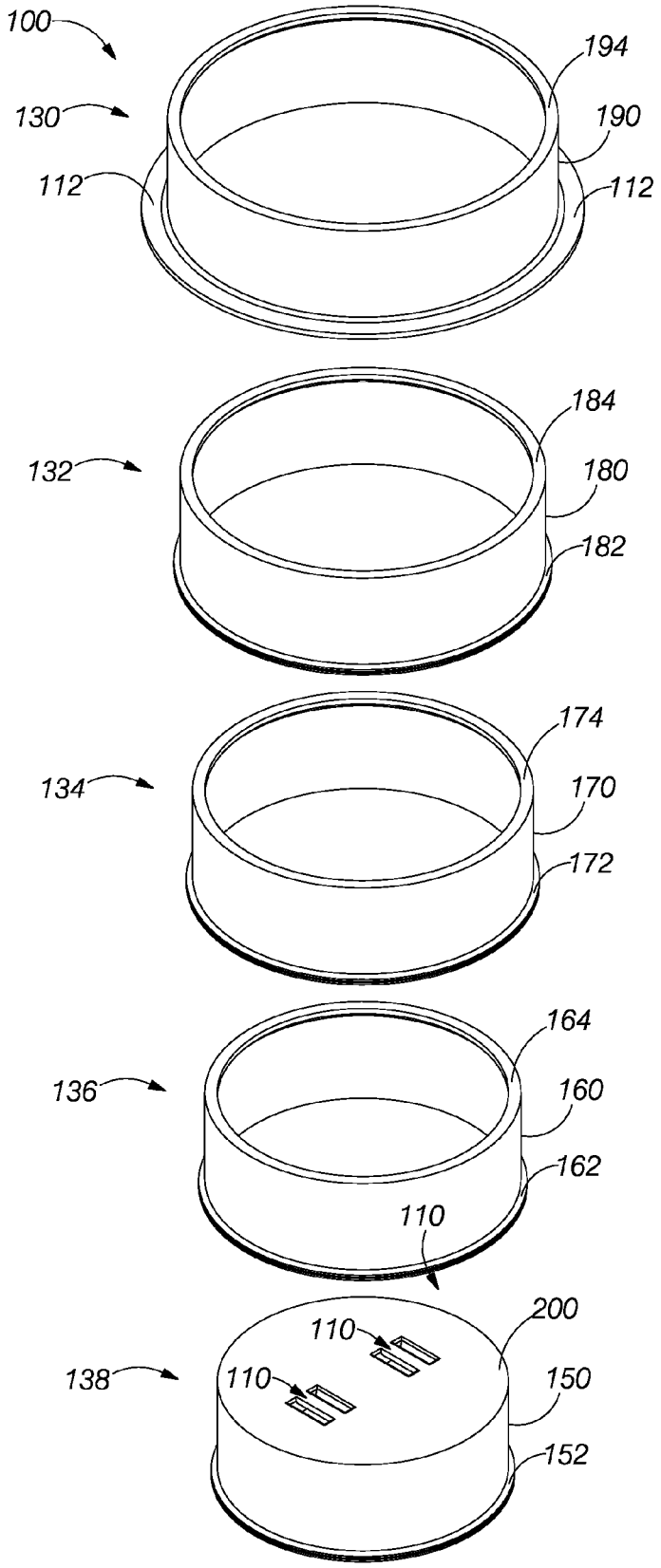
FIG. 5 illustrates an exploded perspective view of the fire protection chamber of FIG. 1 showing each of the nested cylindrical tiers of the chamber.
Figure 6:
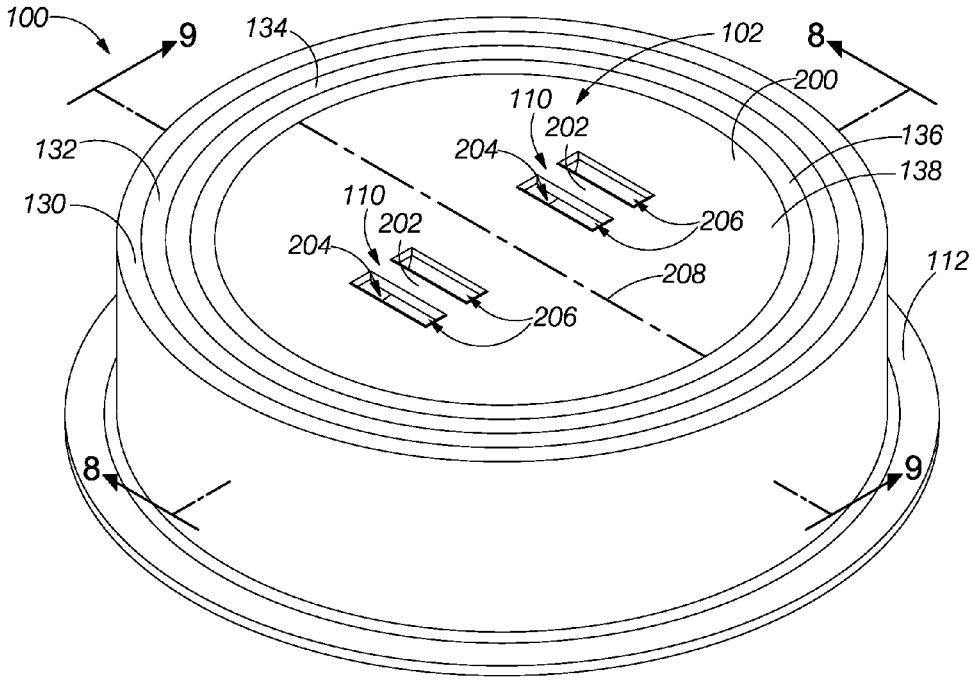
FIG. 6 illustrates the cylindrical tiers of the fire protection chamber of FIG. 5 fully nested as viewed from the top of the collapsed chamber.
Figure 10:
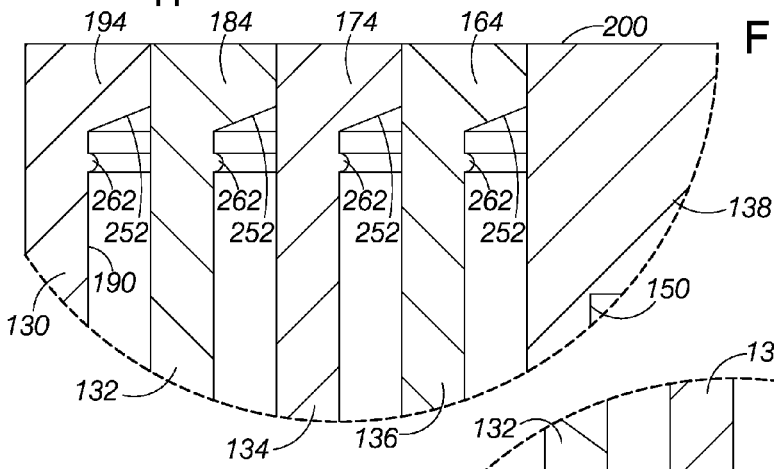
FIG. 10 illustrates an enlarged cross-sectional view of the collapsed fire protection chamber of FIG. 9 taken within the area —10—in FIG. 9.
Figure 11:
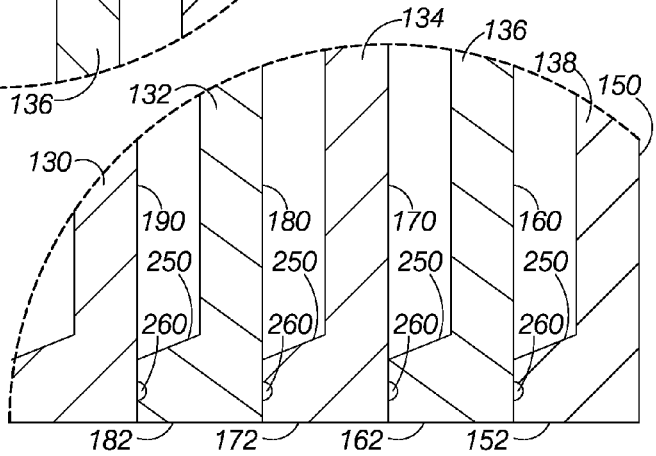
FIG. 11 illustrates an enlarged cross-sectional view of the collapsed fire protection chamber of FIG. 9 taken within the area —11—in FIG. 9.

FIG. 5 illustrates an exploded perspective view of the five cylindrical enclosure members (tiers) 130, 132, 134, 136, 138 of the fire protection chamber 100 prior to forming the collapsed configuration shown in FIGS. 1 and 2. The collapsed configuration is shown in again in an enlarged view in FIG. 6 and in a rotated enlarged view in FIG. 7. The collapsed view of FIG. 6 is further illustrated in two cross-sectional views in FIGS. 8 and 9 and in two enlarged cross-sectional views in FIGS. 10 and 11.

In FIG. 5, the top enclosure member (the fifth (upper) tier) 138 is initially positioned at the bottom. The fifth tier has a main cylindrical body 150 having a selected outer circumference. The fifth tier has a lower outwardly extending ledge 152 having a selected outer circumference that is greater than the outer circumference of the main cylindrical body. As discussed above, the upper end of the fifth tier is closed.

Figure 7:
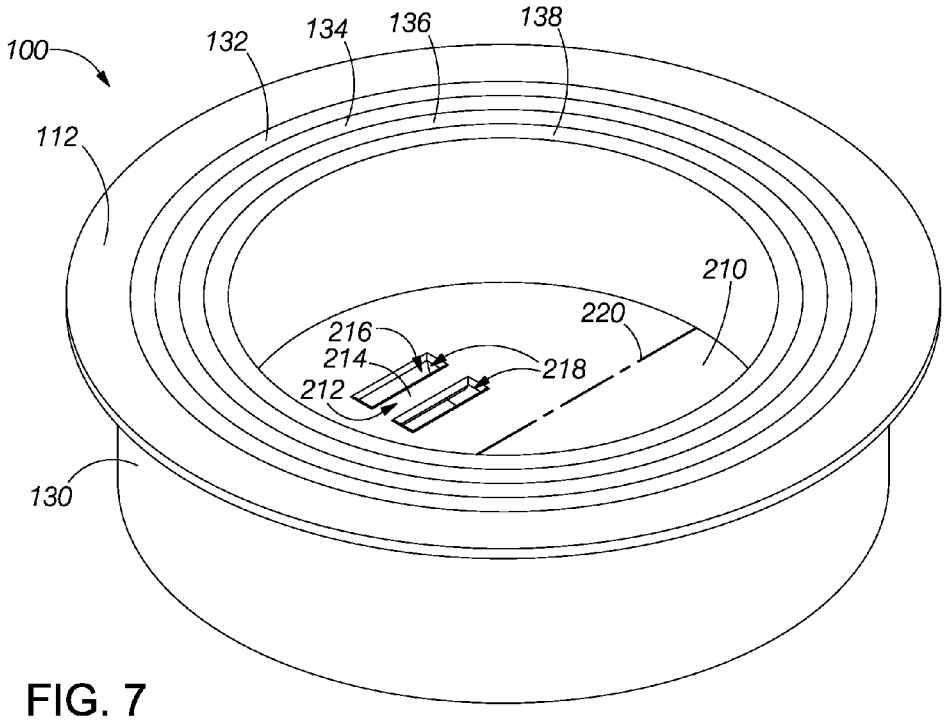
FIG. 7 illustrates the cylindrical tiers of the fire protection chamber of FIG. 5 fully nested as viewed from the bottom of the collapsed chamber.

As shown in FIG. 5, the fourth tier 136 is open at both ends. The fourth tier has a main cylindrical body 160 having a selected outer circumference and a selected inner circumference. The fourth tier has a lower outwardly extending ledge 162 having a selected outer circumference that is greater than the outer circumference of the main cylindrical body. The fourth tier also has an upper inwardly extending ledge 164 that has a selected inner circumference that is less than the inner circumference of the main cylindrical body of the fourth tier. The inner circumference of the main cylindrical body of the fourth tier is selected to be slightly less than the outer circumference of the lower outwardly extending ledge 152 of the fifth tier so that the outwardly extending ledge of the fifth tier fits snugly within the inner circumference of the cylindrical body of the fourth tier while remaining moveable within the cylindrical body of the fourth tier. The inner circumference of the inwardly extending ledge of the fourth tier is slightly greater than the outer circumference of the main cylindrical body 150 of the fifth tier so that the main cylindrical body of the fifth tier fits snugly within the inwardly extending ledge of the fourth tier. As shown in FIGS. 6 and 7, the fifth tier is positioned within the fourth tier with the inwardly extending upper ledge of the fourth tier and the outwardly extending lower ledge of the fifth tier centering the cylindrical body of the fifth tier within the cylindrical body of the fourth tier. It should be understood that the selection of the outer and inner circumferences of the ledges and the surfaces of the cylindrical bodies are selected so that circumferences of the ledges touch or almost touch the circumferences of the respective cylindrical bodies so as to minimize any air gap between opposing surfaces without binding the surfaces because of frictional forces. For example, the inner and outer diameters of opposing surfaces may differ by approximately 1/32 inch to provide a 1/64 inch gap between opposing surfaces. Any binding effect between surfaces is reduced because the vertical edges of the inwardly and outwardly extending edges that are close to the surfaces of the cylindrical bodies only extend for approximately 5/8 inch in the vertical direction. There is no direct contact between the main cylindrical bodies of the nested tiers.

The third tier 134 has a main cylindrical body 170 having a selected outer circumference and a selected inner circumference. The inner circumference of the main cylindrical body of the third tier is slightly greater than the outer circumference of the outwardly extending lower ledge 162 of the fourth tier. The third tier has an outwardly extending lower ledge 172 that has an outer circumference greater than the outer circumference of the main cylindrical body of the third tier. The third tier has an inwardly extending upper ledge 174 that has a selected inner circumference that is less than the inner circumference of the main cylindrical body of the third tier. The inner circumference of the inwardly extending upper ledge of the third tier is slightly greater than the outer circumference of the main cylindrical body of the fourth tier so that the main cylindrical body of the fourth tier fits snugly within the inwardly extending ledge of the third tier. As shown in FIGS. 6 and 7, the fourth tier is positioned within the third tier with the inwardly extending upper ledge of the third tier and the outwardly extending lower ledge of the fourth tier centering the cylindrical body of the fourth tier within the cylindrical body of the third tier.

The second tier 132 has a main cylindrical body 180 having a selected outer circumference and a selected inner circumference. The inner circumference of the main cylindrical body of the second tier is slightly greater than the outer circumference of the outwardly extending lower ledge 172 of the third tier. The second tier has an outwardly extending lower ledge 182 that has an outer circumference greater than the outer circumference of the main cylindrical body of the second tier. The second tier has an inwardly extending upper ledge 184 that has a selected inner circumference that is less than the inner circumference of the main cylindrical body of the second tier. The inner circumference of the inwardly extending upper ledge of the second tier is slightly greater than the outer circumference of the main cylindrical body of the third tier so that the main cylindrical body of the third tier fits snugly within the inwardly extending ledge of the second tier. As shown in FIGS. 6 and 7, the third tier is positioned within the second tier with the inwardly extending upper ledge of the second tier and the outwardly extending lower ledge of the third tier centering the cylindrical body of the third tier within the cylindrical body of the second tier.

The first tier 130 has a main cylindrical body 190 having a selected outer circumference and a selected inner circumference. The inner circumference of the main cylindrical body of the first tier is slightly greater than the outer circumference of the outwardly extending lower ledge 182 of the second tier. The first tier includes the outwardly extending lower rim 112 that has an outer radius that is selected so that the lower rim provides a sufficiently large engagement surface for the soles or heels of a firefighter's boots. For example, the lower rim may have a radius that is approximately 2 inches larger than the outer radius of the main cylindrical body to provide a 2-inch rim. The first tier has an inwardly extending upper ledge 194 that has a selected inner circumference that is less than the inner circumference of the main cylindrical body of the first tier. The inner circumference of the inwardly extending upper ledge of the first tier is slightly greater than the outer circumference of the main cylindrical body of the second tier so that the main cylindrical body of the second tier fits snugly within the inwardly extending ledge of the first tier. As shown in FIGS. 6 and 7, the second tier is positioned within the first tier with the inwardly extending upper ledge of the first tier and the outwardly extending lower ledge of the second tier centering the cylindrical body of the second tier within the cylindrical body of the first tier.

The foregoing relationships between the fifth and fourth tier are shown in more detail in the cross-sectional views of FIG. 8-11. As shown in the cross-sectional views, the second tier 132 is nested with in the first tier 130; the third tier 134 is nested within the second tier; the fourth tier 136 is nested within the third tier; and the fifth tier 138 is nested within the fourth tier. The nesting of the tiers is similar to the nesting of the tiers of a vintage collapsible cup used by campers (commonly referred to as a "Boy Scout cup").

In the illustrated embodiment, the first tier 130 has a height (when positioned on the ground or other horizontal surface) of approximately 11½ inches. The heights of the second tier 132, the third tier 134, the fourth tier 136 and the fifth tier 138 are generally the same as the height of the first tier.

The main cylindrical body 190 of the first tier 130 has an inside radius of approximately 19 inches and an outer radius of approximately 19⅝ inches. The lower rim 112 of the first tier has an outside radius of approximately 22¼ inches. The inner radius of the inwardly extending upper ledge 194 is approximately ⅝ inch less than the inner radius of the main cylindrical body (e.g., approximately 18⅜ inches).

The main cylindrical body 180 of the second tier 132 has an inner radius of approximately 17¾ inches and an outer radius of approximately 18⅜ inches. The outwardly extending lower ledge 182 of the second tier has an outer radius of approximately 19 inches. The inwardly extending upper ledge 184 of the second tier has an inner radius of approximately 17⅛ inches.

The main cylindrical body 170 of the third tier 134 has an inner radius of approximately 16½ inches and an outer radius of approximately 17⅛ inches. The outwardly extending lower ledge 172 of the third tier has an outer radius of approximately 17¾ inches. The inwardly extending upper ledge 174 of the third tier has an inner radius of approximately 15⅞ inches.

The main cylindrical body 160 of the fourth tier 136 has an inner radius of approximately 15¼ inches and an outer radius of approximately 15⅞ inches. The outwardly extending lower ledge 162 of the third tier has an outer radius of approximately 16½ inches. The inwardly extending upper ledge 164 of the third tier has an inner radius of approximately 14⅝ inches.

The main cylindrical body 150 of the fifth tier 138 has an inner radius of approximately 14 inches and an outer radius of approximately 14⅝ inches. The outwardly extending lower ledge 152 of the third tier has an outer radius of approximately 15¼ inches. The fifth tier does not have an inwardly extending upper ledge. Rather, the top of the fifth tier is closed. In the illustrated embodiment, the top of the fifth tier has a thickness of approximately 2½ inches in order to accommodate two sets of handles (described below).

It should be understood that the foregoing dimensions are just examples of dimensions for one embodiment. The dimensions can be varied to enlarge or reduce the sizes of the tiers in order to accommodate larger or smaller persons. Additional tiers may be provided to accommodate taller persons. The thicknesses of the cylindrical walls may also be varied to provide greater thermal protection (e.g., protection for longer durations or in the presence of higher temperatures. Furthermore, the cited inner and outer radii are variable in order to accommodate manufacturing tolerances. As discussed above, the various tiers nest snugly within each other but are easily moved to expand the fire protection chamber 100 to the deployed configuration shown in FIG. 3.

Figure 8:
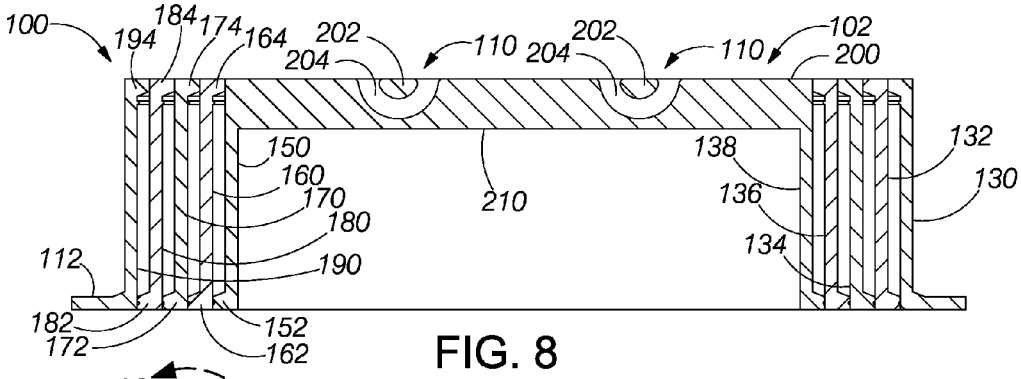
FIG. 8 illustrates a cross-sectional view of the collapsed fire protection chamber of FIG. 6 taken along the line 8-8 in FIG. 6, the view showing the upper lifting handles of the chamber.

As further shown in FIG. 6 and in the cross-sectional view in FIG. 8, an upper surface 200 of the top of the fifth tier 138 includes the two deployment handles 110. The deployment handles may be attached to the upper surface by suitable means; however, in the illustrated embodiment, the deployment handles are formed into the top surface as part of the molding process that forms the fifth tier. The configuration of the deployment handles can be further understood by viewing the cross-sectional view of FIG. 8, which shows that each handle comprises a central semicircular bar 202 surrounded by an annular cavity 204. In the illustrated embodiment, the bar has a diameter of approximately 1 inch, and the annular cavity has an inner diameter of 1 inch and an outer diameter of 2 inches. The annular cavity intersects the upper surface to form two generally rectangular openings 206 on either side of the central bar. Preferably, fillets are formed on the edges of the openings. The two deployment handles are positioned symmetrically with respect to an upper centerline 208 on the upper surface. The firefighter extends his or her fingers into one of the rectangular openings for each handle and grasps the central bar to pull the fifth tier from the nesting position shown. In certain embodiments, the central bar may be reinforced with a suitable reinforcing material inserted during the molding process or added as a laminate after the molding process.

Figure 9:
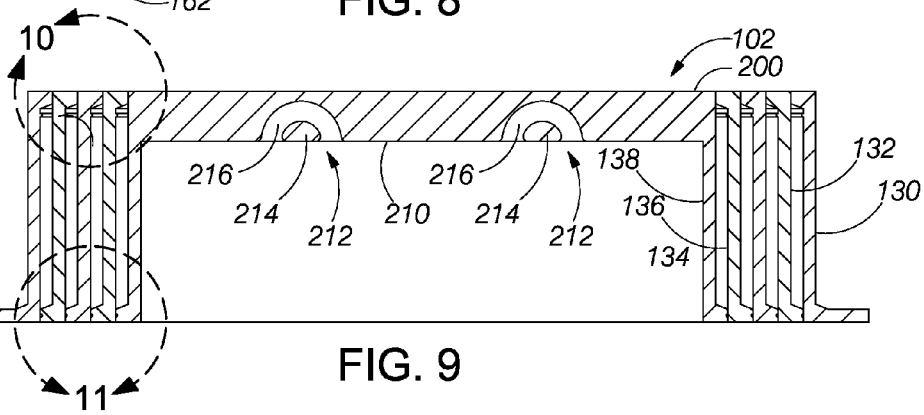
FIG. 9 illustrates a cross-sectional view of the collapsed fire protection chamber of FIG. 6 taken along the line 9-9 in FIG. 6, the view showing the lower retaining handles of the chamber.

As shown in FIG. 7 and in the cross-sectional view of FIG. 9, a lower surface 210 of the top of the fifth tier 138 includes two retaining handles 212. Only one of the two retaining handles is shown in FIG. 6. The other retaining handle is shown in the cross-sectional view of FIG. 9. The retaining handles are formed in similar manner to the deployment handles 110. The retaining handles have respective central bars 214 surrounded by annular cavities 216. The intersections of the annular cavities with the lower surface form rectangular openings 218, which have fillets on each edge. The two retainer handles are positioned symmetrically with respect to a lower centerline 220 on the lower surface. The lower centerline is orthogonal to the upper centerline 208 such that the handles formed in the lower surface are displaced from the handles on the upper surface so that the reduced thicknesses of the top caused by the upper and lower handles are not coincident.

Figure 12:
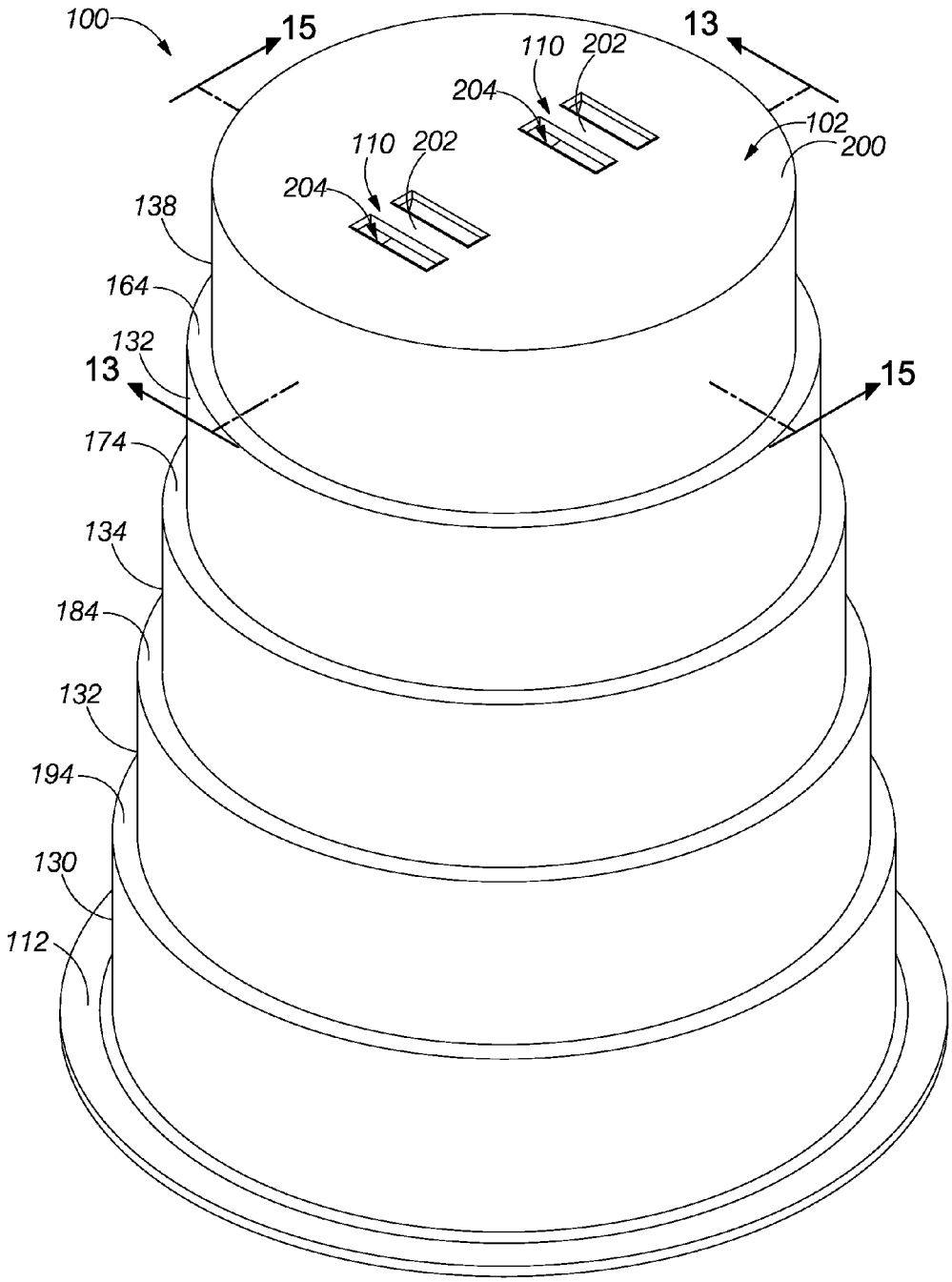
FIG. 12 illustrates the fully expanded fire protection chamber as previously shown in FIG. 3.
Figure 13:
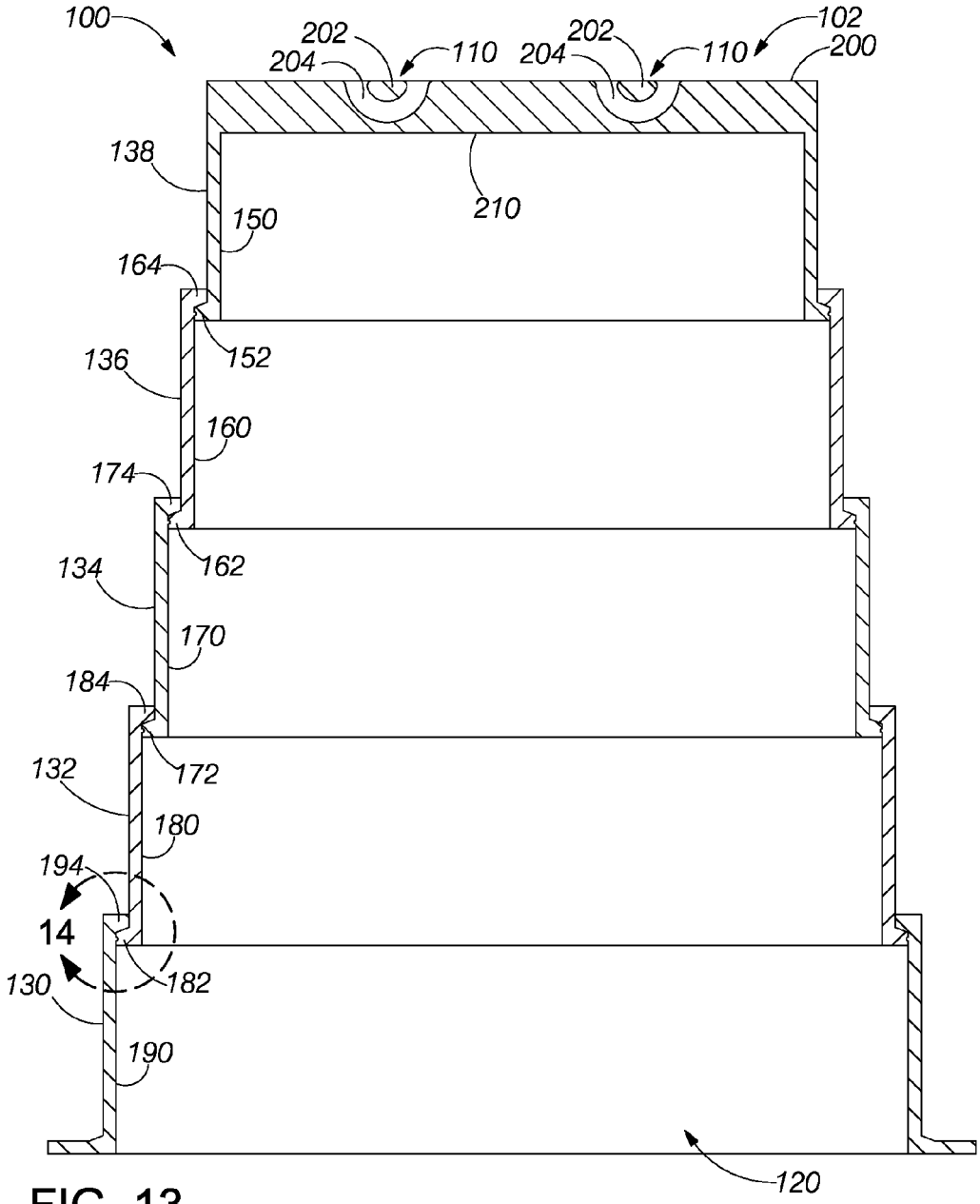
FIG. 13 illustrates a cross-sectional view of the expanded fire protection chamber of FIG. 6 taken along the line 13-13 in FIG. 12, the view including a cross-sectional view of the upper lifting handles of the chamber.

When fully deployed, the five tiers 130, 132, 134, 136, 138 form the expanded configuration of the fire protection chamber 100 shown again in an enlarged view in FIG. 12. Further details are shown in the cross-sectional views in FIGS. 13, 14 and 15. In particular, as shown in FIGS. 13 and 15, when the chamber is fully deployed (fully expanded), an upper engagement surface 250 of the outwardly extending lower ledge 182 of the second tier engages a lower engagement surface 252 of the inwardly extending upper ledge 194 of the first tier. As illustrated in the cross-sectional view, the engagement surfaces of the ledges are angled at approximately 45 degrees with respect to the surfaces of the tiers so that the ledges are thicker at the roots of the ledges.

Figure 14:
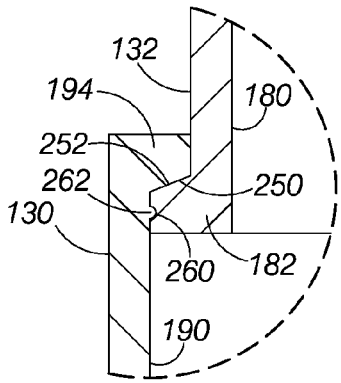
FIG. 14 illustrates an enlarged cross-sectional view taken within the circular area —14—in FIG. 13, the view showing the engagement surface of the lower outwardly extending ledge of the second tier engaging the engagement surface of the inwardly extending ledge of the first tier.
Figure 15:
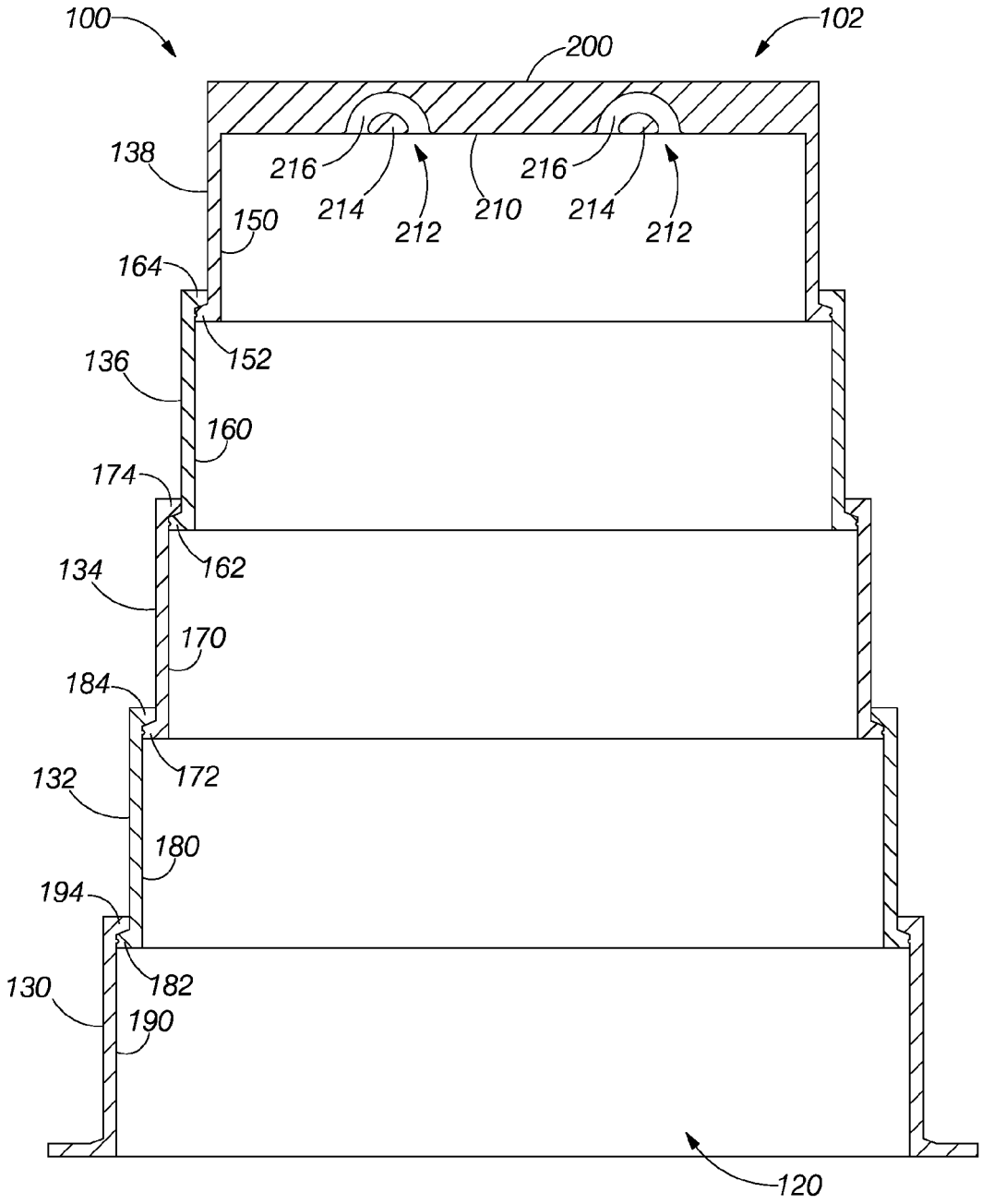
FIG. 15 illustrates a cross-sectional view of the expanded fire protection chamber of FIG. 15 taken along the line 15-15 in FIG. 12, the view including a cross-sectional view of the lower retaining handles of the chamber.

As further shown in the enlarged cross-sectional view of FIG. 14, the outward extending lower ledge 182 of the second tier includes a semicircular indentation 260 that extends around the outer circumference of the ledge. A corresponding semicircular raised portion 262 is formed on the inner circumference of the main cylindrical body 190 of the first tier. The raised portion is positioned so that the semicircular indentation on the extended lower ledge of the second tier engages the raised portion when the engagement surfaces 250, 252 of the ledges are in contact. The engagement of the raised portion and the indentation assist in maintaining the fire protection chamber in the fully deployed configuration. Similar indentations and raised portions are positioned between the corresponding elements of the second tier and the third tier, the third tier and the fourth tier, and the fourth tier and the fifth tier.

As discussed above, when the fire protection chamber 100 is in the fully deployed (fully expanded) configuration shown in FIGS. 12, 13 and 15, a firefighter positions himself or herself in the inner cavity 120 in a squatting, sitting or kneeling position and extends his or her hands upward to grasp the retaining handles 212 to hold the lower surface of the first tier 130 onto the surface.

When positioned within the fully deployed fire protection chamber 100, the firefighter is supplied with oxygen via a conventional emergency air supply system that is a conventional part of the firefighter's equipment.

Figure 16:
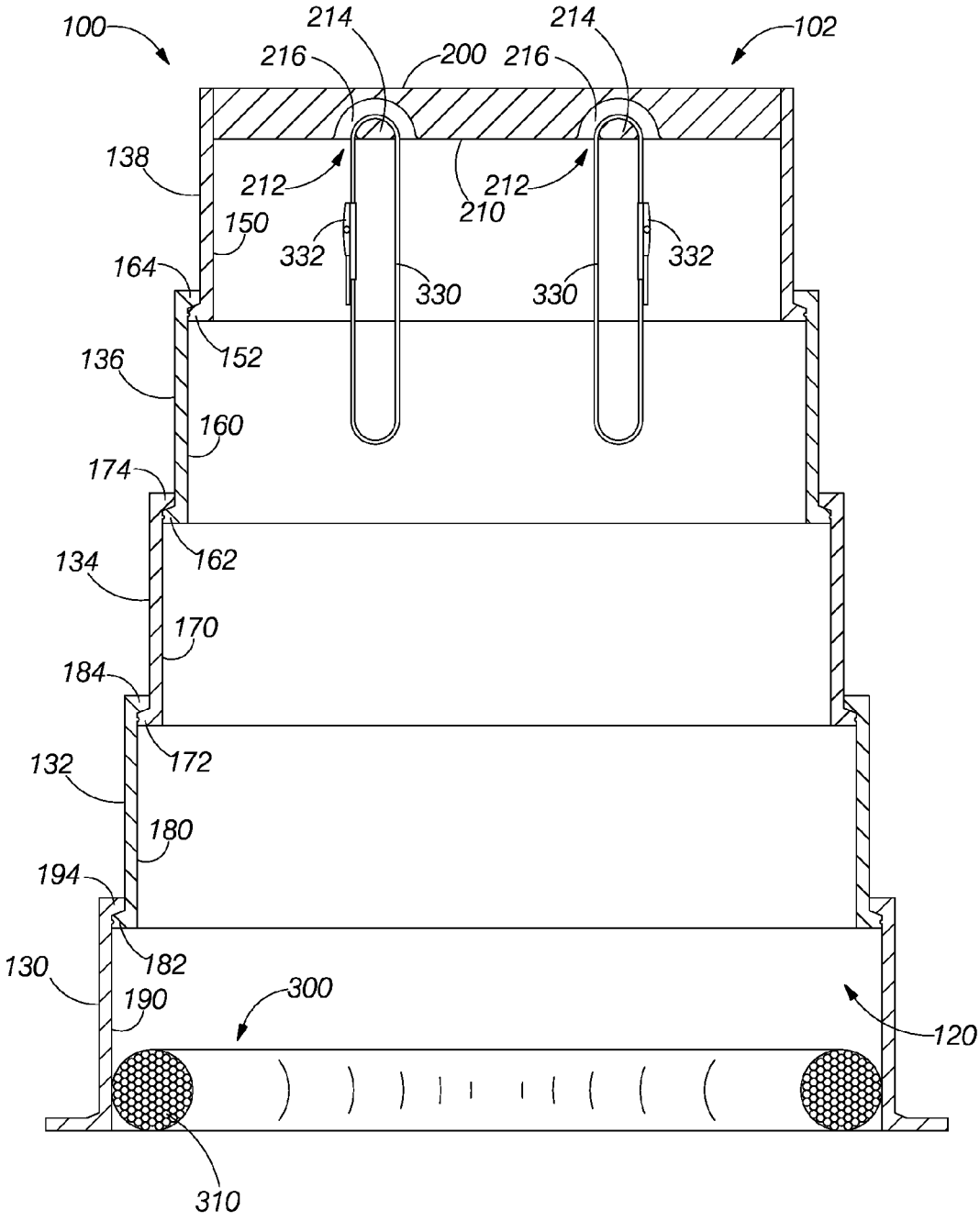
FIG. 16 illustrates the cross-sectional view of the expanded chamber of FIG. 15 with a flexible fire protection seal positioned around the inner perimeter of the chamber, and further showing optional retaining straps.

In certain embodiments, the fire protection chamber 100 further includes a flexible lower barrier 300 show in the cross-sectional view of FIG. 16. The barrier is positioned around the inner circumference of the first tier 130 at the ground level. In the illustrated embodiment, the flexible lower barrier comprises a generally tubular enclosure of carbon fiber cloth having a diameter of approximately 3 inches. The enclosure is filled with a plurality of small spheres 310 or other shapes comprising the TPS silica material (e.g., the LI-900 or LI-2200 material) to form a closed sack-like structure. The barrier has a total length selected to correspond to the inner circumference of the first tier (e.g., approximately 115½ inches for the illustrated embodiment). The barrier can readily be curled within the inner circumference of the fifth tier 138 when the chamber is in the collapsed (non-deployed) configuration. After expanding the chamber, the barrier is pulled downward from the fifth tier and positioned around the inner circumference of the first tier to compensate for uneven terrain and to further block wind-driven heated air.

FIG. 16 further illustrates optional retaining straps 330 that may be included with the fire protection chamber 100. Rather than grasping the retaining handles 212 directly, as described above, the retaining straps are passed around the central bar 214 of retaining handles and are formed into respective loops using respective buckles 332. In the illustrated embodiment, the retaining straps advantageously comprise conventional military belt webbing and the buckles advantageously comprise convention military belt buckles that operate by frictional engagement of the webbing to allow the straps to be adjusted to a desired length. For example, the straps can be adjusted to allow the occupant of the fire protection chamber to position his or her forearm or upper arm in the lower loop of the straps in order to more easily apply his or her body weight to hold down the fire protection chamber in the presence of strong winds.

Figure 17:
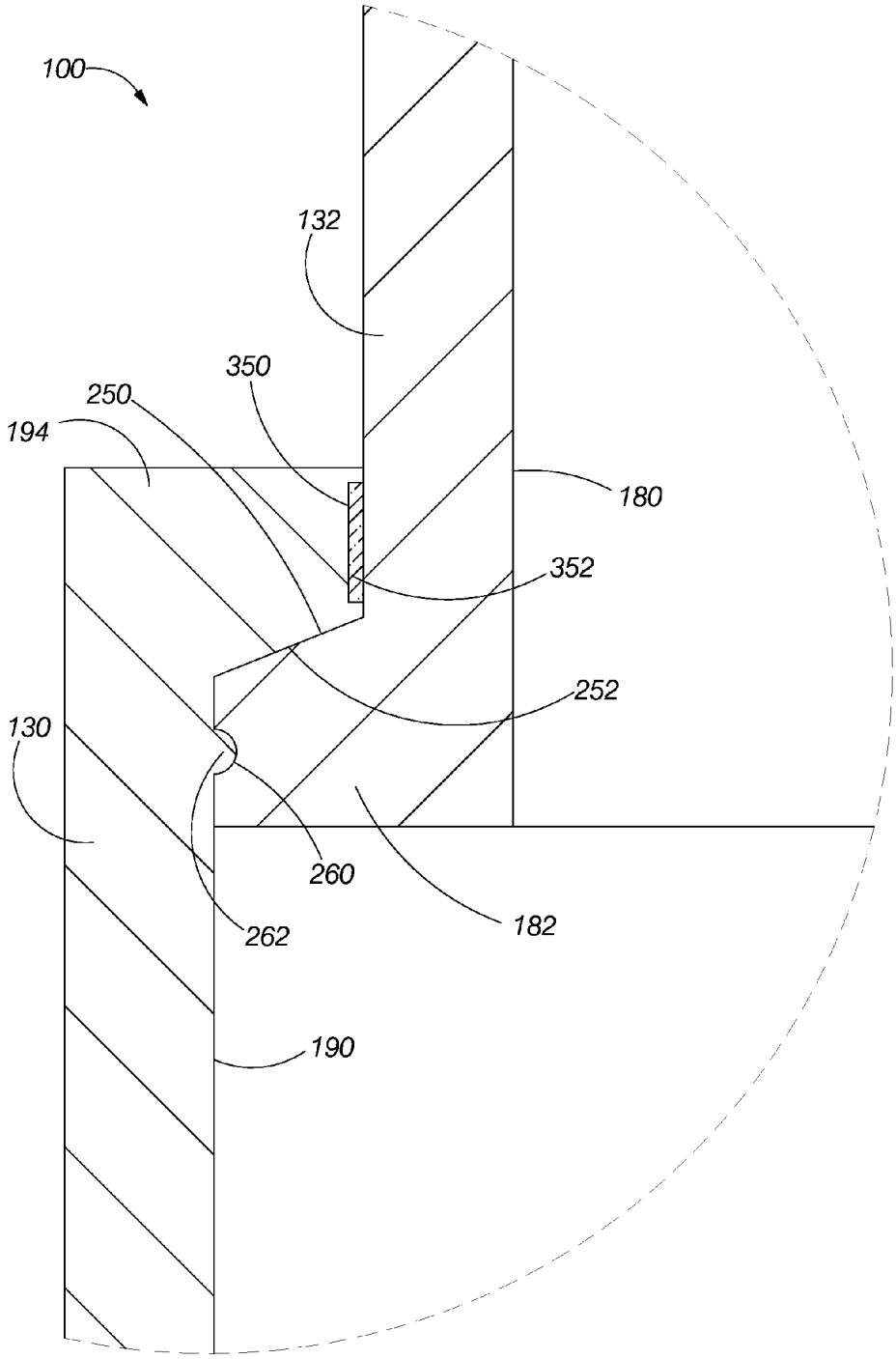
FIG. 17 illustrates an elevational cross-sectional view corresponding to the view in FIG. 14, the view in FIG. 17 illustrating an alternative embodiment of the fire protection chamber in which an intumescent strip is positioned around the perimeters of the tiers of the chamber to provide additional fire protection.

FIG. 17 is a cross-sectional view similar to the enlarged cross-sectional view of FIG. 14 that shows a further modification of the fire protection chamber 100. In particular, the inner circumference of the inwardly extending upper ledge 194 of the first tier has a groove 350 formed therein that extends around the entire inner circumference of the ledge. A strip 352 of intumescent tape is secured within the groove. Such tape is commercially available from 3M Building and Commercial Services Division, St. Paul, Minn., as 3M™ Expantrol™ Flexible Intumescent Strip E-FIS. The tape includes an adhesive backing to secure the tape within the groove. The tape expands when exposed to heat and fully seals the gap between the inner circumference of the inwardly extending upper ledge of the first tier and the outer circumference of the main body of the second tier to prevent the passage of fire, smoke and toxic gases. Similar grooves and tape are installed in corresponding grooves in the inwardly extending upper ledges of the second, third and fourth tiers.

Figure 18:
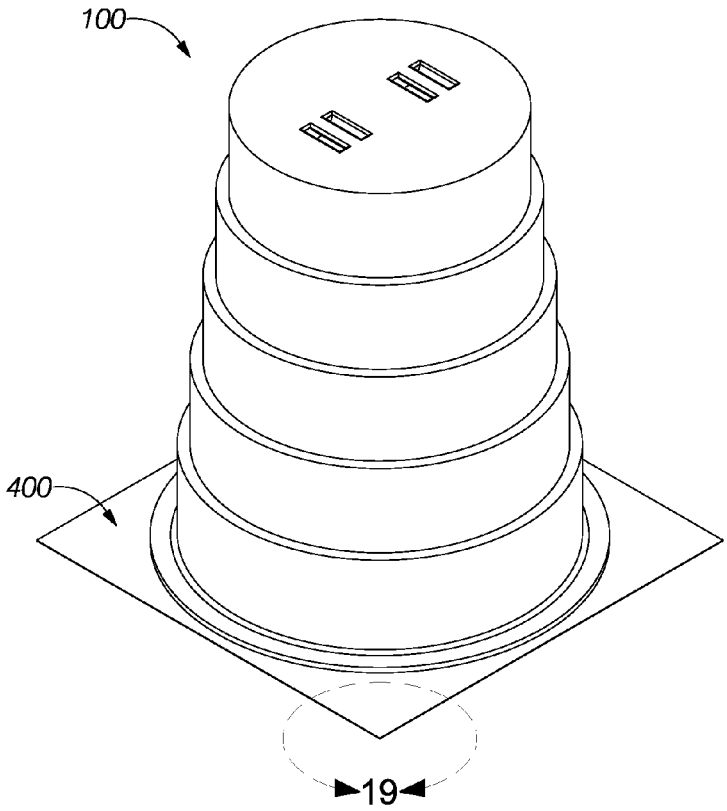
FIG. 18 illustrates a perspective view of the fire protection chamber positioned on a heat-resistant ground blanket.

FIG. 18 illustrates a perspective view of a further embodiment of the fire protection chamber 100 in which the fire protection chamber is placed on a protective blanket 400 after the chamber is expanded as shown in FIG. 18. In the illustrated embodiment, the blanket is generally rectangular (e.g., square). The blanket is sized so that at least the inner circumference of the chamber is entirely on the upper surface of the blanket. In the illustrated embodiment, the blanket has sides that are slightly larger than the outside diameter of the chamber so that the blanket extends beyond the outer circumference of the blanket.

Figure 19:
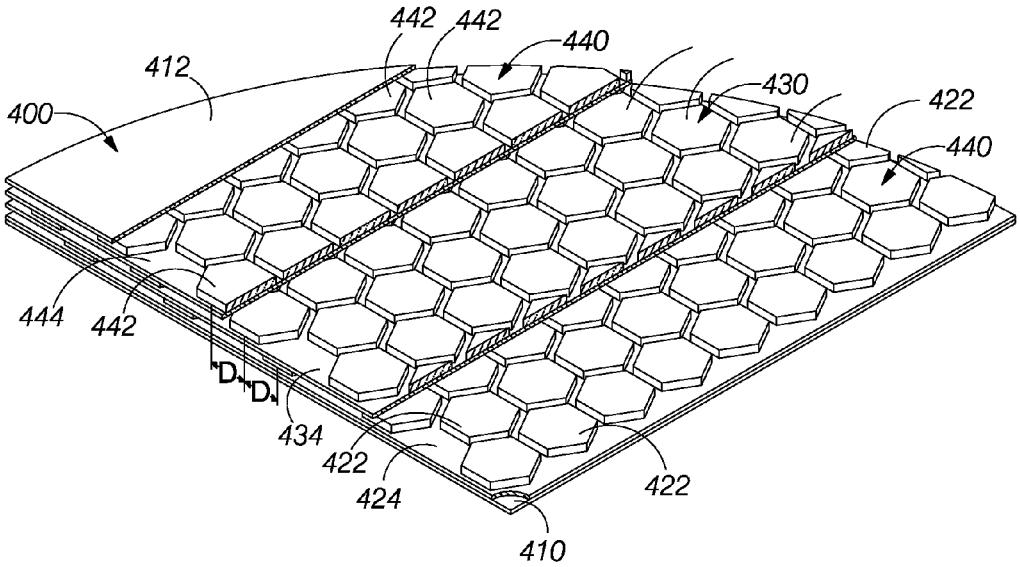
FIG. 19 illustrates an enlarged perspective view of the ground blanket of FIG. 19 taken within the area —19— with portions of upper layers broken away to show lower layers.

As illustrated in the enlarged, partially broken perspective view of a corner of the blanket 400 in FIG. 19, the blanket comprises a plurality of layers. A lowermost layer 410 and an uppermost layer 412 comprise a flame-resistant fiber material such as a meta-aramid material. One such commercially available material is marketed by DuPont as NOMEX®. Other fire-resistant fabrics may also be used.

In the illustrated embodiment, the blanket 400 further comprises a first layer 420 of TPS tiles 422 bonded to a carbon fiber sheet 424. In the illustrated embodiment, the TPS tiles are approximately ⅛ inch thick and are shaped as hexagons. Each hexagon has a flat-to-flat dimension of approximately 15/16 inch. The hexagonal tiles are advantageously spaced apart by a center-to-center distance of approximately 1 inch so that a ⅛ inch gap is provided between the flats of adjacent hexagons. The hexagonal tiles are arranged in a repeating honeycomb-like pattern so that each tile (other than the border tiles) is surrounded by six adjacent tiles as shown.

The blanket 400 further includes a second layer 430 of TPS tiles 432 bonded to a carbon fiber sheet 434. In the illustrated embodiment, the TPS tiles in the second layer are also shaped as hexagons and have a flat-to-flat dimension of approximately 15/16 inch. The TPS tiles in the second layer are spaced apart by a corresponding distance as the TPS tiles 422 in the first layer 420. The TPS tiles in the second layer are shifted with respect to the TPS tiles in the first layer so that the tiles in the second layer cover portions of the gaps between the adjacent tiles in the first layer. For example, in the illustrated embodiment, the centers of the tiles in the second layer are spaced horizontally apart from the center of the nearest of the tiles in the first layer by a distance D, where D corresponds to the center-to-center distance multiplied by $\sqrt{3}$.

The blanket 400 further comprises a third layer 440 of TPS tiles 442 bonded to a carbon fiber sheet 444. In the illustrated embodiment, the TPS tiles in the third layer are also shaped as hexagons and have a flat-to-flat dimension of approximately 15/16 inch. The TPS tiles in the third layer are also spaced apart by a corresponding distance as the TPS tiles 422 in the first layer 420. The TPS tiles in the third layer are shifted with respect to the TPS tiles in the second layer so that the tiles in the third layer cover the remaining gaps not covered by the tiles of the first layer and the second layer 430. For example, in the illustrated embodiment, the centers of the tiles in the third layer are spaced horizontally apart from the center of the nearest of the tiles in the second layer by the distance D.

Although described above with respect to hexagonal tiles of a particular size, it should be understood that tiles having different shapes and different sizes may also be used to form the TPS layers 420, 430, 440. Furthermore, the tiles in one layer may be different from the tiles in other layers. In each embodiment, thermal transfer through the blanket 400 is blocked by at least one layer of tiles, and most locations, the thermal transfer is blocked by two or three layers where the tiles overlap.

In the illustrated embodiment, the three TPS layers 420, 430, 440 of the blanket 400 are bound along the edges to the lowermost layer 410 and the uppermost layer 412 of NOMEX®; however, the layers are not bound together between the edges. Accordingly, the spaces between the adjacent tiles in each TPS layer allow the blanket to be rolled or folded so that the blanket can be carried on the firefighters back until the blanket is needed.

The foregoing disclosure and the accompany drawings illustrate a portable fire protection chamber that may be easily transported by a firefighter to a fire event. If sudden changes in conditions place the firefighter at risk, the chamber may be quickly placed on the ground and expanded so that the firefighter may enter the cavity thus formed and be surrounded by a thermally protective barrier.

As various changes could be made in the above constructions without departing from the scope of the invention, it is intended that all the matter contained in the above description or shown in the accompanying drawings shall be interpreted as illustrative and not in a limiting sense.

What is claimed is:

1. A portable, expandable fire protection enclosure having a collapsed transportable configuration and an expanded occupiable configuration, comprising:

a base enclosure member comprising a perimeter wall of a thermally resistant material, the perimeter wall having an inner surface and an outer surface, the base enclosure member having an open top and an open bottom, the perimeter wall proximate the open top extending inwardly to form an upper ledge;

at least one intermediate enclosure member, the at least one intermediate enclosure member having at least one perimeter wall of the thermally resistant material, the at least one perimeter wall having an inner surface and an outer surface, the at least one intermediate enclosure member having an open top and an open bottom, the at least one intermediate enclosure member having an upper ledge extending inwardly from the inner surface of the at least one perimeter wall proximate the open top, the at least one intermediate enclosure member having a lower ledge extending outwardly from the outer surface of the at least one perimeter wall proximate the open bottom, the at least one intermediate enclosure member nested within the base enclosure member in the collapsed transportable configuration, the at least one intermediate enclosure member slidable upwards within the base enclosure member to engage the lower ledge of the at least one intermediate enclosure member with the upper ledge of the base enclosure member in the occupiable configuration; and a top enclosure member having a perimeter wall of the thermally conductive material, the perimeter wall having an inner surface and an outer surface, the top enclosure member having an open bottom and a closed top, the top enclosure member having a lower ledge extending outwardly from the outer surface of the perimeter wall proximate the open bottom, the top enclosure member nested within the at least one intermediate enclosure member in the collapsed transportable configuration, the top enclosure member slidable upwards within the at least one intermediate enclosure member to engage the lower ledge of the top enclosure member with the upper ledge of the at least one intermediate enclosure member in the occupiable configuration.

2. The fire protection enclosure as defined in claim 1, wherein thermally resistant material comprises thermal protection system (TPS) silica.

3. The fire protection enclosure as defined in claim 1, wherein:

the at least one intermediate enclosure member comprises a first intermediate enclosure member, a second intermediate enclosure member and a third intermediate enclosure member;

each intermediate enclosure member has a respective perimeter wall;

each perimeter wall has a respective inner surface and a respective outer surface;

each intermediate enclosure member has a respective upper ledge extending inwardly from the respective inner surface and a respective lower ledge extending outwardly from the respective outer surface;

the first intermediate enclosure member nests within the base enclosure member in the transportable configuration;

the second intermediate enclosure member nests within the first intermediate enclosure member in the transportable configuration;

the third intermediate enclosure member nests within the second intermediate enclosure member in the transportable configuration; and the top enclosure member nests within the third intermediate enclosure member in the transportable configuration.

4. The fire protection enclosure as defined in claim 3, wherein:

the lower ledge of the first intermediate enclosure member engages the upper ledge of the base enclosure member in the occupiable configuration;

the lower ledge of the second intermediate enclosure member engages the upper ledge of the first intermediate enclosure member in the occupiable configuration;

the lower ledge of the third intermediate enclosure member engages the upper ledge of the second intermediate enclosure member in the occupiable configuration; and the lower ledge of the top enclosure member engages the upper ledge of the third intermediate enclosure member in the occupiable configuration.

5. The fire protection enclosure as defined in claim 1, wherein:

the lower ledge of the at least one intermediate enclosure member includes an outer perimeter, the inner surface of the base enclosure member has an inner perimeter; and the outer perimeter of the lower ledge of the at least one intermediate enclosure member is sized to engage the inner surface of the base enclosure member without inhibiting movement of the outer perimeter of the lower ledge within the inner perimeter of the base enclosure.

6. The fire protection enclosure as defined in claim 5, further comprising:

a first engagement feature formed in the outer perimeter of the outwardly extending lower ledge of the first intermediate enclosure member; and a second engagement feature formed in the inner surface of the base enclosure member below the inwardly extending upper ledge of the base enclosure member, the second engagement feature positioned on the inner surface such that the second engagement feature is juxtaposed with the first engagement feature when the lower ledge of the first intermediate enclosure member engages the upper ledge of the base enclosure member, the second engagement feature being sized and shaped to mate with the first engagement feature.

7. The fire protection enclosure as defined in claim 1, wherein an outer surface of the top of the top enclosure member includes a handle that is graspable to pull the top enclosure member and the at least one intermediate enclosure member upward with respect to the base enclosure member to expand the fire protection enclosure from the transportable configuration to the occupiable configuration.

8. The fire protection enclosure as defined in claim 7, wherein the base enclosure member further comprises a rim that extends outwardly from the bottom of the outer surface of the perimeter wall of the base enclosure member, the rim being engageable with a boot or other foot protection to hold the base enclosure member down while pulling the top enclosure member and the at least one intermediate enclosure member upward.

9. The fire protection enclosure as defined in claim 7, wherein an inner surface of the top of the top enclosure member includes a handle that is graspable by a person within the fire protection enclosure in the occupiable configuration to enable the person to retain the fire protection enclosure in a position over the person.

10. The fire protection enclosure as defined in claim 1, further comprising a flexible lower barrier positionable around the inner surface of the perimeter wall of the base enclosure member to provide additional protection against the entry of heated air into the fire protection enclosure, the barrier comprising a plurality of thermally resistant spheres housed within a fire-resistant fabric.

11. The fire protection enclosure as defined in claim 1, further comprising a thermally protective blanket that is positionable between the bottom of the base enclosure member and a surface, the thermally protective blanket comprising at least one layer of thermally resistant tiles contained between first and second layers of thermally resistant fabric.

12. The fire protection enclosure as defined in claim 11, wherein the thermally resistant tiles comprise thermally protection system (TPS) silica material spaced to form a matrix between the two layers.

13. A method of providing portable fire protection, comprising:

transporting an expandable fire protection enclosure to a location proximate to a fire, the fire protection enclosure being in a collapsed, transportable configuration, the expandable fire protection enclosure comprising at least a base enclosure member, an intermediate enclosure member and a top enclosure member, with the top enclosure member nested within the intermediate enclosure member and the intermediate enclosure member nested within the base enclosure member;

placing the expandable fire protection enclosure on a surface with a top of the fire protection enclosure parallel to the surface;

positioning the feet of a person on a rim extending from a base enclosure member of the expandable fire protection enclosure;

pulling upward on a top surface of top enclosure member of the expandable fire protection enclosure to expand the expandable fire protection enclosure from the collapsed, transportable configuration to an occupiable configuration wherein a lower ledge of the intermediate enclosure member engages an upper ledge of the base enclosure member and wherein a lower ledge of the top enclosure member engages an upper ledge of the intermediate enclosure member; and positioning the occupiable configuration of the expandable fire protection enclosure over a person to be protected from the fire.

14. The method as defined in claim 13, wherein the occupiable configuration of the expandable fire protection enclosure is positioned on a fire protection blanket.

15. The method as defined in claim 13, wherein a flexible thermal barrier is positioned around an inner perimeter of the base enclosure of the occupiable configuration of the expandable fire protection enclosure.

* * * * *